US009041316B2

(12) United States Patent
Pi et al.

(10) Patent No.: US 9,041,316 B2
(45) Date of Patent: May 26, 2015

(54) ADJUSTABLE SOLID STATE ILLUMINATION MODULE HAVING ARRAY OF LIGHT PIXELS

(75) Inventors: Bo Pi, Carlsbad, CA (US); Li Xu, Saratoga, CA (US)

(73) Assignee: Axlen, Inc., Wilmington, DE (US)

( * ) Notice: Subject to any disclaimer, the term of this patent is extended or adjusted under 35 U.S.C. 154(b) by 43 days.

(21) Appl. No.: 13/806,676

(22) PCT Filed: Jun. 27, 2011

(86) PCT No.: PCT/US2011/042063

§ 371 (c)(1),
(2), (4) Date: Jun. 17, 2013

(87) PCT Pub. No.: WO2011/163672

PCT Pub. Date: Dec. 29, 2011

(65) Prior Publication Data

US 2013/0257287 A1 Oct. 3, 2013

(51) Int. Cl.

*H05B 37/00* (2006.01)
*G05F 1/00* (2006.01)
*H05B 33/08* (2006.01)

(52) U.S. Cl.

CPC ..... *H05B 33/0845* (2013.01); *H05B 33/0818* (2013.01); *H05B 33/086* (2013.01); *H05B 33/0854* (2013.01)

(58) Field of Classification Search

CPC ..... H05B 37/02; H05B 33/08; G09G 5/00; G09G 3/30
USPC ..... 315/291, 312, 294; 345/603, 549, 690, 345/204, 77, 81, 82
See application file for complete search history.

(56) References Cited

U.S. PATENT DOCUMENTS 6,122,042 A * 9/2000 Wunderman et al. ..... 356/73
6,498,440 B2 * 12/2002 Stam et al. ..... 315/291

(Continued)

FOREIGN PATENT DOCUMENTS

KR 10-2008-0089380 A 10/2008
KR 10-2009-0059505 A 6/2009

(Continued)

OTHER PUBLICATIONS

International Search Report and Written Opinion mailed on Feb. 9, 2012 for International Application No. PCT/US2011/042063, filed Jun. 27, 2011 (8 pages).

*Primary Examiner* — Minh D A
(74) *Attorney, Agent, or Firm* — Perkins Coie LLP

(57) ABSTRACT

Techniques for constructing a solid-state lighting module that includes solid-state light emitters that emit light of different colors and are selected from separated groups of solid-state light emitters that emit light of two or more separated colors, wherein one or more solid-state light emitters are selected from each of the separated color groups of solid-state light emitters. The lighting module includes a programmable device that stores or remembers desirable optical intensities of the separated color groups of solid-state light emitters, and a control circuit that individually controls light intensity of each of the separated color groups of solid-state light emitters. The light control circuit is coupled to or in communication with the programmable device to receive the desirable optical intensities of the separated groups of solid-state light emitters and is operable to adjust the intensities of the separated color groups of solid-state light emitters based on the desirable intensities.

18 Claims, 6 Drawing Sheets

Turn on each LED group with a short pulse, separate to each other, so a single detector can measure intensity of each group. As indicated by M1,M2,..., Mn LED module tuning and control algorithm

(56) References Cited

U.S. PATENT DOCUMENTS

| | | | | |
|---|---|---|---|---|
| 7,148,470 | B2 | 12/2006 | Rains, Jr. et al. | |
| 2009/0033612 | A1* | 2/2009 | Roberts et al. | 345/102 |
| 2009/0189530 | A1* | 7/2009 | Ashdown et al. | 315/152 |
| 2009/0278789 | A1* | 11/2009 | Declercq et al. | 345/102 |

FOREIGN PATENT DOCUMENTS

| | | | |
|---|---|---|---|
| KR | 10-2010-0055294 | A | 5/2010 |
| WO | 20071066112 | A1 | 6/2007 |

* cited by examiner

A LED light module

Adjust each LED group intensity by control the turn on/off time of each group

Adjust each LED group intensity by control the drive currents of each group

Turn on each LED group with a short pulse, separate to each other, so a single detector can measure intensity of each group. As indicated by M1,M2,..., Mn A LED module with three color groups combination LED module tuning and control algorithm

ADJUSTABLE SOLID STATE ILLUMINATION MODULE HAVING ARRAY OF LIGHT PIXELS

PRIORITY CLAIM AND RELATED APPLICATIONS

This application is a 35 USC §371 National Stage application of, and claims priority of, International Application No. PCT/US2011/042063 filed Jun. 27, 2011, which further claims the benefit of priority to U.S. Provisional Application No. 61/358,835 entitled "A HIGHLY ADJUSTABLE SOLID STATE ILLUMINATION MODULE AND THE METHOD OF MAKING IT" filed Jun. 25, 2010, the disclosure of which is incorporated by reference as part of the specification of this document.

BACKGROUND

This patent document relates to lighting devices and techniques, including designs and operations of light devices having an array of light pixels.

Lighting devices can be constructed by using light pixels arranged in an array where each light pixel is controlled to emit light. Each light pixel can be a light-emitting diode (LED) or a laser diode (LD).

SUMMARY

Techniques for constructing a solid-state lighting module that includes solid-state light emitters that emit light of different colors and are selected from separated groups of solid-state light emitters that emit light of two or more separated colors, wherein one or more solid-state light emitters are selected from each of the separated color groups of solid-state light emitters. The lighting module includes a programmable device that stores or remembers desirable optical intensities of the separated color groups of solid-state light emitters, and a control circuit that individually controls light intensity of each of the separated color groups of solid-state light emitters. The light control circuit is coupled to or in communication with the programmable device to receive the desirable optical intensities of the separated groups of solid-state light emitters and is operable to adjust the intensities of the separated color groups of solid-state light emitters based on the desirable intensities. In another implementation, a solid state lighting module includes multiple LEDs or semiconductor laser diodes (LDs), an optional detection system, and a control system to produce a desirable color profile. In one implementation, the LED or LD power and light spectrum can be measured and the measured results are used to calculate one or multiple set of control profiles. The module is then controlled to produce a desirable color profile output based on the calculated profiles.

These and other features are described in detail in the drawings, the description and the claims.

DETAILED DESCRIPTION

Figure 1:
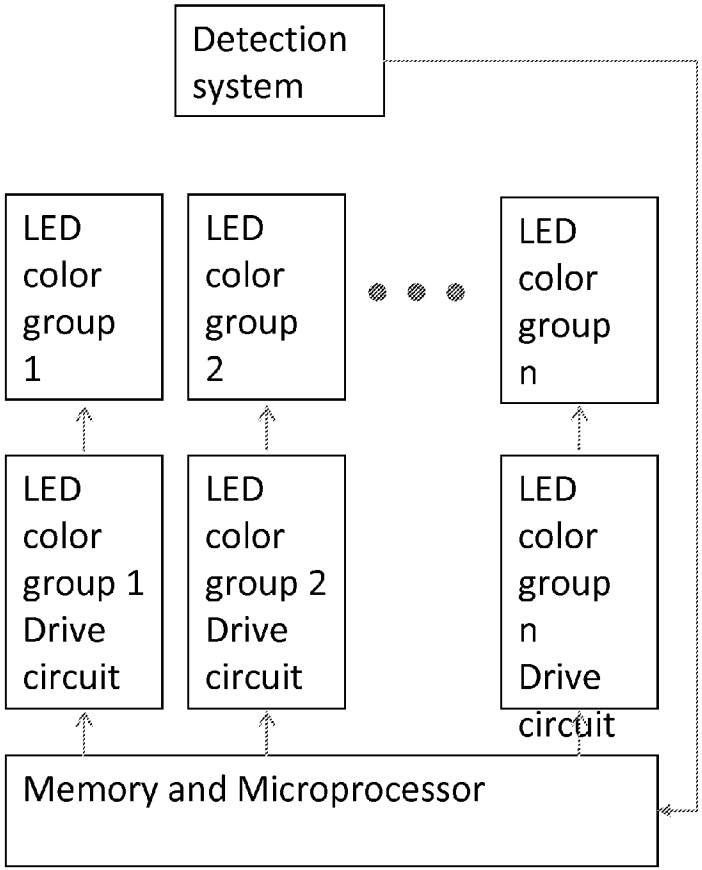
FIG. 1 shows one embodiment.

A semiconductor LED light source has certain light spectrum output, multiple such LEDs can be combined, e.g., LEDs that emit light of different colors, to produce a variety of color output with different colors. Such LEDs with different colors can be LED lights combined with different phosphor materials that emit light of different color under optical excitation of the LEDs light or can be LEDs based on semiconductor materials that emit light of different colors. Due to the production variation of LED chips, and differences in phosphor performance, LED light spectrum of a single color may have variations from one LED to another LED or from one chip to another chip. The LED light spectrum of a single color may also change over time due to aging and other time-dependent factors. In addition, the LED intensity may change over time due to aging or a change in its environment. Any of these and other effects may cause the combined light output color to shift over time, or to vary between production lots.

The techniques described in this document can be used to provide lighting module designs and production methods that may be used to, in some implementations, mitigate these problems. The specific examples described below are for LED-based lighting devices and the techniques associated with such examples can be extended to other light pixels such as laser diodes.

Based on the techniques described herein, a light device can include solid-state light emitters (e.g., LEDs or LDs) that emit light of different colors and are selected from groups of solid-state light emitters that emit light of two or more separated colors, e.g., any two or more of selected colors, such as red, green, blue and yellow. One or more solid-state light emitters are selected from each of the separated color groups. This light device includes a programmable device that stores or remembers desirable optical intensities of these groups of solid-state light emitters, and a control circuit that individually controls light intensity of each of the separated color groups of solid-state light emitters. The light control circuit is coupled to or in communication with the programmable device to receive the desirable optical intensities of these groups of solid-state light emitters. The light control circuit is operable to adjust the intensities of these groups of solid-state light emitters based on the desirable intensities.

In another implementation, the adjustable light device can include an optional light detection module that detects optical intensities of the separated color groups of solid-state light emitters. The light control circuit is coupled to or in communication with the light detection module to receive measurements of optical intensities of the separated color groups of solid-state light emitters and is coupled to or in communication with the programmable device to receive the desirable optical intensities of these groups of solid-state light emitters. The light control circuit is operable to adjust the intensities of these groups of solid-state light emitters based on the desirable intensities.

In another implementation, a solid-state lighting module can be configured to include one or more solid-state light emitters from each of three or more separated colors groups, a light detection system that detects the optical intensities of these groups of LEDs, a programmable device that stores or remembers the desirable optical intensities of these groups of solid-state light emitters, and a control circuit that individually controls intensity of these groups of solid-state light emitters, and uses the light detection system measurements to adjust the intensities of these groups of solid-state light emitters to the desirable intensities.

The above adjustable light devices can be operated to provide the adjustment to offset or compensate for variations in the color and light power that are caused by various factors and thus enable the output of the light device to produce a desirable output in the presence of the variations to the light device.

The above adjustable light device can be used to ensure color production to meet certain color reproduction standards. For example, this device can be used for solid-state illumination source especially LED illumination source to provide a color reproduction capability to meet the specification of CRI comparing to traditional light source such as incandescent lamp or Xenon lamp which has CRI equal or better than 95 since its photons are generated from a blackbody radiation process. One of common white LEDs with luminescent material (such as YAG based phosphors) on blue LED produces white color near blackbody locus with CRI typically around 80 due to low optical output at red and green spectrum range of typical luminescent material. The above adjustable light device and other device designs with multiple color groups described in this document can be used to address this challenge and to produce high CRI output.

It is often technically difficult for a high CRI illumination source to adjust color temperature. For traditional illumination source or conventional solid-state illumination device, the color temperature can be pre-determined by choice of filament and/or luminescent material. With multiple color groups and independent intensity control as described in this document, a light module with adjustable color temperature and output lumen while maintaining high CRI can be constructed.

FIG. 1 illustrates one example a multiple LED module design. This device is built with multiple groups of LEDs with different colors. Each group has its own power driven circuits, and the intensity of each group output can be controlled independently of other groups, through a programmable device, like microcontroller, microprocessor etc., and there is a memory device either inside programmable microcontroller, or outside as external device, built into the module. The spectrum and power information of the each color group, and one or multiple sets of control parameters to drive each color group to archive one or multiple desirable color profiles are stored in the memory device during the manufacturing process or are programmed into the memory device post the manufacturing. When the LED module is in use, manufacturer or user can select the set of control parameters to archive desirable color profile and power output.

In some implementations, a light detection system or module can be provided to measure the light output power of each color group, and microcontroller can use the measurement data from the light detection module to adjust the light output intensity of each color group to insure the LED module color profile and power output is fixed at desirable value. This detection/control feedback design is to insure the light output level of each color group is at a preset level. In the case of aging of the LEDs, or shift of the component value or environments, this feedback design can archive fixed light output level for each color group and the whole LED module. This combination of the light detection and feedback to the control circuit can be beneficial in various applications where the combined light output color of the module is dependent on the relative power output level of each color group. And LED output level can be affected by aging, and environments. This combination of the light detection and feedback to the control circuit provides a mechanism to counter the effects caused by device aging, environments and other factors.

For example, three color groups of light emitters of LEDs/LDs can be constructed in an adjustable light device, such as a blue group of light emitters (blue LEDs), a yellow group of light emitters (realized with blue LED or UV plus yellow phosphors), and a red group of light emitters (red LEDs, or LED with red phosphors, or red laser diodes).

For another example, three color groups can include a green group of light emitters (green LEDs or realized with blue LED or UV plus green phosphors), a yellow group of light emitters (realized with blue LED or UV plus yellow phosphors), and a red group of light emitters (red LEDs, or LED with red phosphors, or red laser diodes).

For another example, four color groups can include a blue group of light emitters (blue LEDs), a yellow group of light emitters (realized with blue or UV LED plus yellow phosphors), a red group of light emitters (red LEDs or red laser diodes), and a green group of light emitters (realized with green LEDs, or blue LEDs with green phosphors, or green laser diodes).

For yet another example, two groups of light emitters can include a blue group of light emitters (blue LEDs), and a yellow group of light emitters (realized with blue LED plus yellow phosphors).

Additional designs of the color groups are provided below. In one example, one group of solid-state light emitter has color of blue LED (dominant wavelength from 435 to 485 nm), and one group of luminescent LED has color of yellow (dominant wavelength from 550 to 585 nm), and a group of LED has color of red (dominant wavelength from 610 to 640 nm). In another example, one group of solid-state light emitter has color of green color LED (dominant wavelength from 515 to 540 nm), and one group of luminescent LED has color of yellow (dominant wavelength from 550 to 585 nm), and a group of LED has color of red (dominant wavelength from 610 to 640 nm). In another example, one group of solid-state light emitter has color of blue LED (dominant wavelength from 435 to 485 nm), and one group of solid-state light emitter has color of green color LED (dominant wavelength from 515 to 540 nm), and one group of luminescent LED has color of yellow (dominant wavelength from 550 to 585 nm), and a group of LED has color of red (dominant wavelength from 610 to 640 nm). In the above examples, the yellow luminescent LED can be made of a yellow luminescent material (such as but not limited to phosphors or quantum dotes) excited by blue or UV LED.

Figure 2:
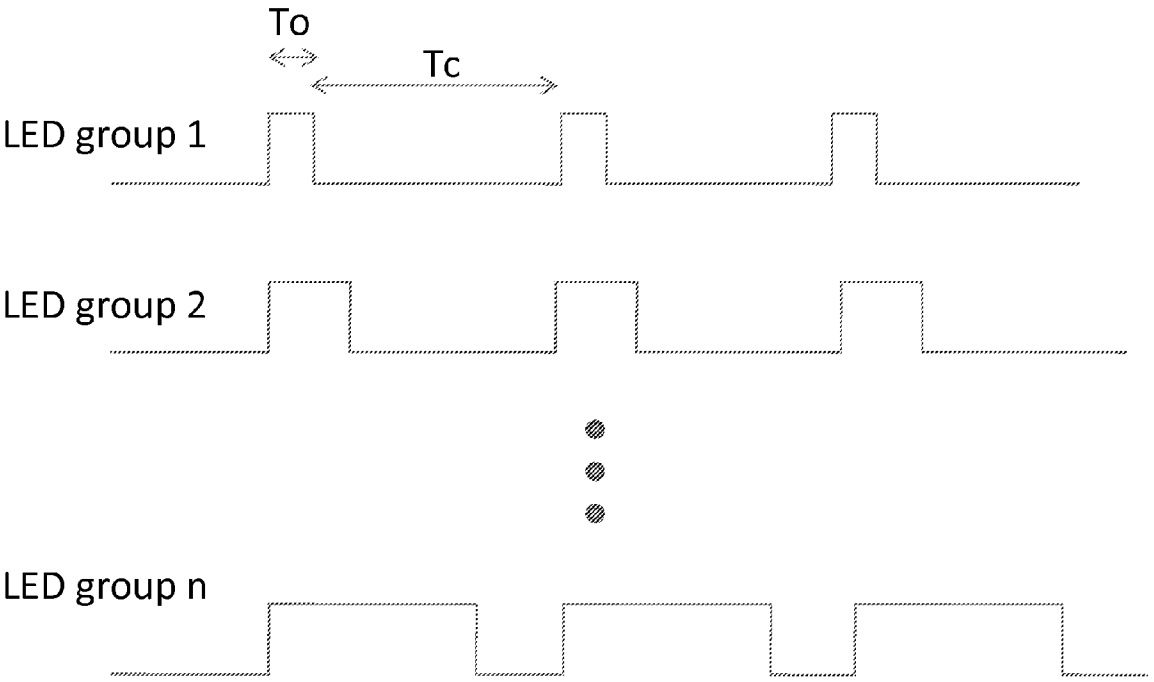
FIGS. 2, 3 and 4 show timing charts associated various features of the device in FIG. 1.

FIG. 2 is a timing chart that illustrates an example for controlling the light output intensity of the LEDs by controlling the turn-on and turn-off time of the LEDs. By controlling the turn-on time To, and turn-off time Tc, such as the ratio between To and Tc, the light output intensity of each color group can be controlled.

Figure 3:
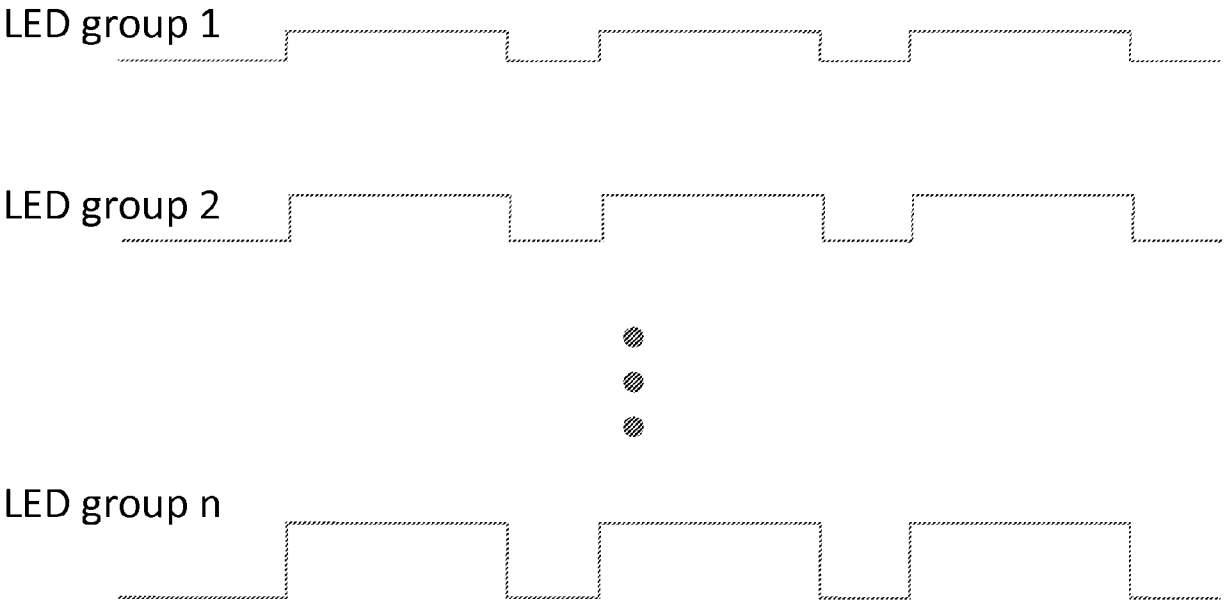

FIG. 3 is a timing chart that illustrates another example for controlling the light output intensity of the LEDs by controlling the currents of each group. The figure indicates that changing the intensity of the current for each LED group can be used to control the light output intensity of each group.

Figure 4:
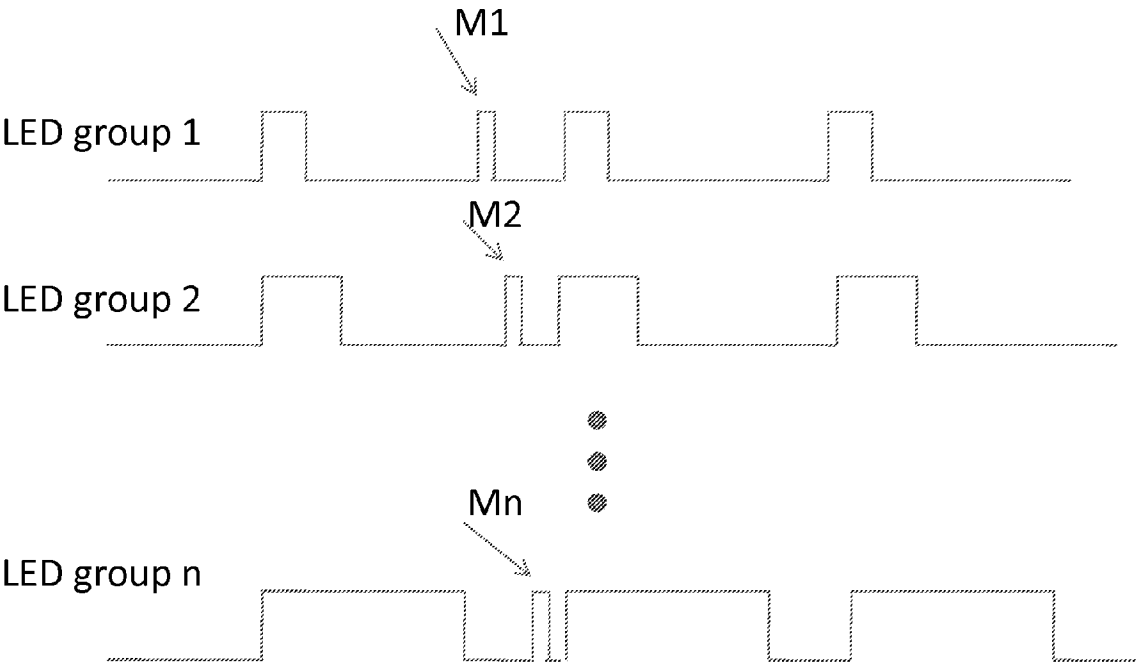

FIG. 4 illustrates a design to measure each color group light output intensity using just one channel of a light detection system. In the timing diagram, during the off time of the LEDs, each color group is turned on in a very short period of time (e.g., 1 us to 50 ms) independently while other color groups are turned off, so the light detection system only measures light output from one color group only. This measurement data is correlated with or corrected with the relative time each color group is turned on to calculate a correct output intensity of the color group. The detection results of the detection system, including the spectrum responses, can be used in the calculation of the light control parameters. This design reduces the need for having multiple detectors that are designated to measure their respective light colors, respectively (each detector is assigned to measure a particular color group).

Figure 5:
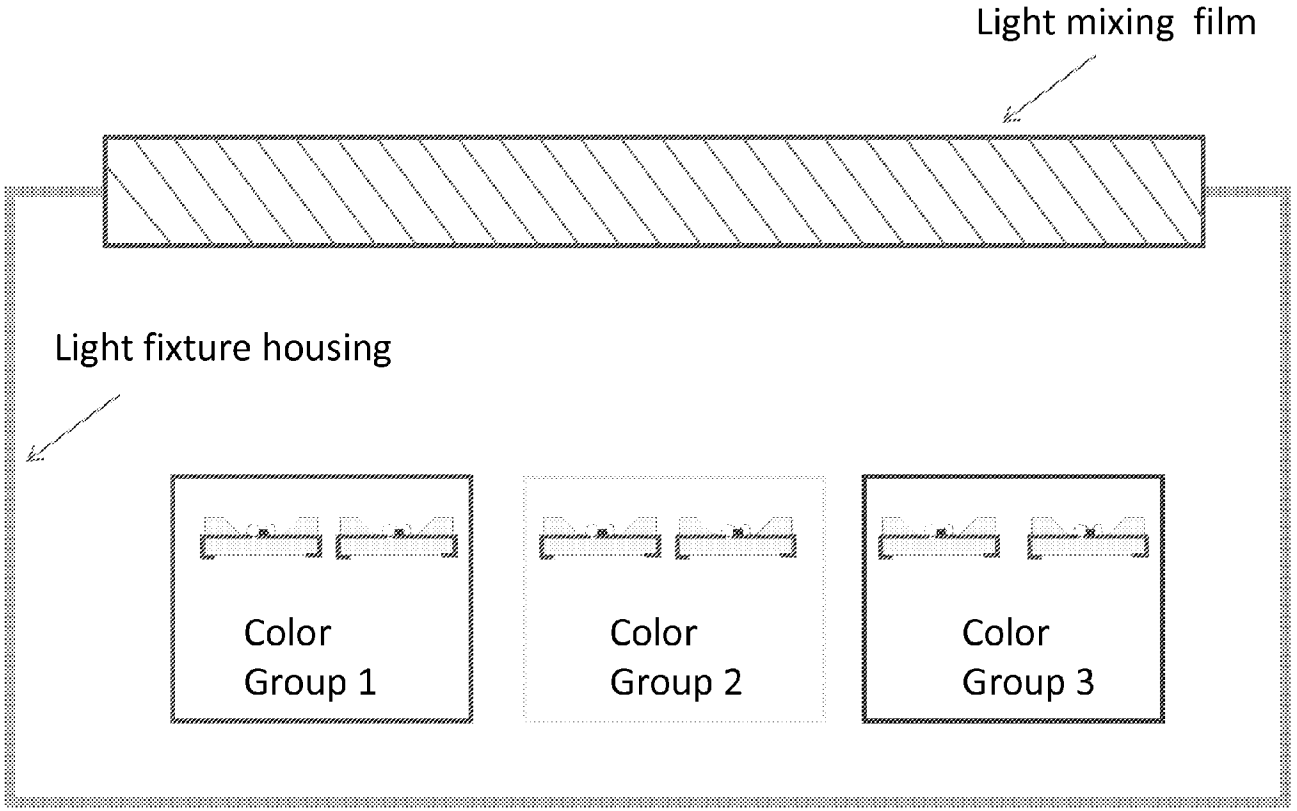
FIG. 5 shows an example of a lighting module with a light mixer.

FIG. 5 illustrate a light module design where there are multiple color groups of LEDs which are placed in a light fixture housing and emit light towards a light output port formed on the light fixture housing. On the light output port, a light mixer is formed to mix the light from different color groups, so the output light is more uniform in color. The light mixer can be a film that is made out of an array of micro structure lenses, or other micro structure as in our other disclosure. In some implementations, the light fixture housing can be made with reflective inner surfaces. The LEDs from different color groups can be placed alternatively spatially and/or in a mixed pattern to achieve better or desired color mixing at the light mixer. The desirable color output profile can be achieved by adjusting, e.g., the relative power output between the color groups. The light detection module can be located so that the light mixing film is located between LEDs and the light detection module.

In one example for implementation of the design, three color groups can be used. One group is primarily blue color. Another group is primarily yellow color, and the third group is primarily red color. The power intensity of each color group can be independently adjusted, by controlling either the current of the LED or the turn-on time of the LED. An optional detection system is made with photo sensitive elements to measure the intensity of the light output for each LED groups. This measurement is fed to a microcontroller which controls the drive current of LED or turn-on time.

Figure 6:
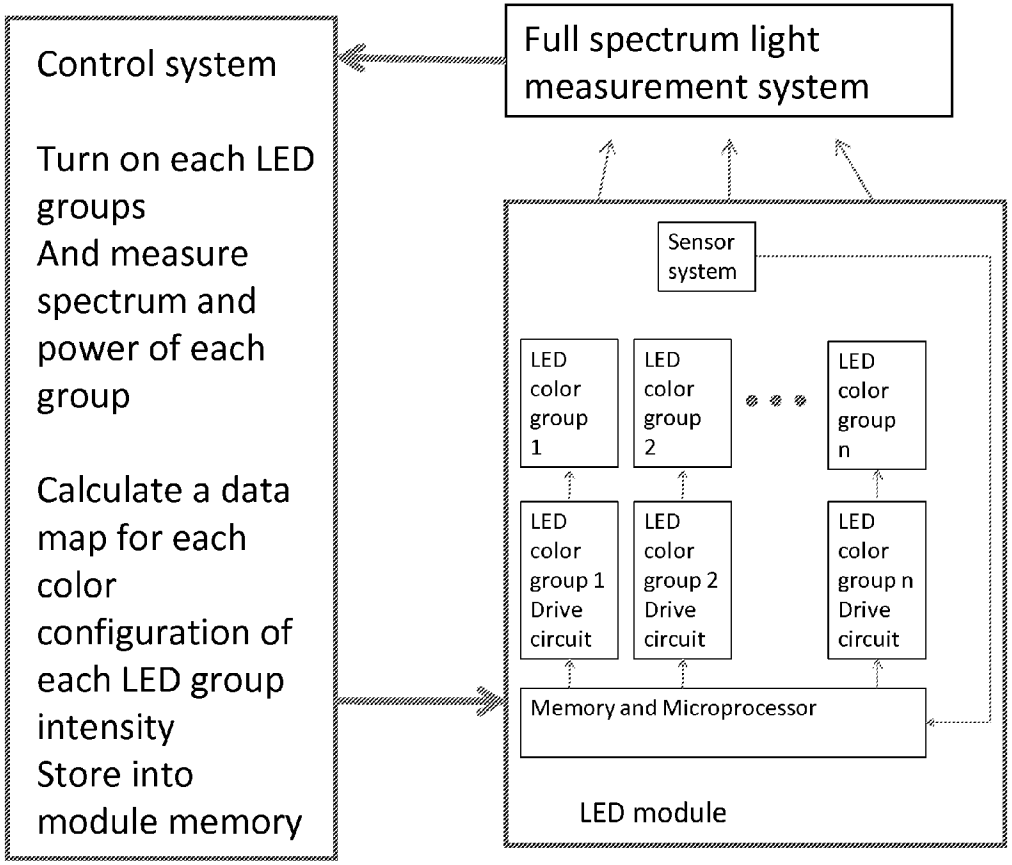
FIG. 6 shows an example for making a lighting module.

FIG. 6 illustrate a method of manufacturing the lighting module. In the manufacture process, a light spectrum measurement and intensity measurement system is used to measure each color group output light. The measurement information is used to calculate a table of relative light output intensity data for each color group, and the corresponding module output light profile. This information is stored in the memory of each LED module. So each LED module is individually calibrated to correct its LED chip wavelength and power variations, phosphor performance variation, and temperature dependences and aging effects. The power correction is performed by adjusting each color group drive current or turn-on time. The color profile correction is performed by adjusting relative power ratios between each color groups. For example, if a high temperature output light profile is needed, and blue LED group can be controlled to produce a relatively higher intensity with respect to the red LED group. For another example, a lower temperature, warmer color output profile can be made by increasing the red LED group output power.

Only a few embodiments are described. Other embodiments and their variations and enhancements can be made based on what is described and illustrated.

What is claimed is:

1. A solid-state lighting module, comprising:

solid-state light emitters that emit light of different colors and are selected from separated groups of solid-state light emitters that emit light of two or more separated colors, wherein one or more solid-state light emitters are selected from each of the separated color groups of solid-state light emitters;

a programmable device that stores or remembers desirable optical intensities of the separated color groups of solid-state light emitters;

a control circuit that individually controls light intensity of each of the separated color groups of solid-state light emitters, the light control circuit being coupled to or in communication with the programmable device to receive the desirable optical intensities of the separated groups of solid-state light emitters and operable to adjust the intensities of the separated color groups of solid-state light emitters based on the desirable intensities; and a light detection system that includes a single photodetector to measure light emission from the separated groups of solid-state light emitters;

wherein during an off time of the solid-state light emitters, the control circuit is configured to control the solid-state light emitters of the separated color groups to turn on each of the separated color groups one at a time during different non-overlapping designated time durations to obtain measurements of light emission of different separated color groups at different respective designated time durations.

2. The solid-state lighting module of claim 1, wherein the control circuit adjusts a solid-state light emitter intensity by changing an amount of time the solid-state light emitter is turned on or a driving current that drives the solid-state light emitter.

3. The solid-state lighting module of claim 1, wherein:

the single photodetector is operable to sense different wavelength spectrum of different solid-state light emitters in different separated color groups of solid-state light emitters.

4. The solid-state lighting module of claim 1, wherein:

the single photodetector is configured to measure intensities of solid-state light emitters within each of the separated color groups during the different time durations when the solid-state light emitters of other separated color groups are turned off.

5. The solid-state lighting module of claim 1, wherein one group of solid-state light emitters has blue LEDs emitting light within a spectral range from 435 nm to 485 nm, and one group of solid-state light emitters has luminescent LEDs emitting yellow light within a spectral range from 550 nm to 585 nm, and a group of solid-state light emitters has red LEDs emitting red light within a spectral range from 610 nm to 640 nm.

6. The solid-state lighting module of claim 5, wherein the yellow luminescent LEDs includes a yellow luminescent material excited by blue or UV light.

7. The solid-state lighting module of claim 1, wherein one group of solid-state light emitters has green color LEDs emitting light within a spectral range from 515 nm to 540 nm, and one group of solid-state light emitters has luminescent LEDs emitting yellow color light within a spectral range from 550 nm to 585 nm, and one group of solid-state light emitters has red LEDs emitting light within a spectral range from 610 nm to 640 nm.

8. The solid-state lighting module of claim 7, wherein the yellow luminescent LEDs includes a yellow luminescent material excited by blue or UV light.

9. The solid-state lighting module of claim 1, wherein one group of solid-state light emitters has blue LEDs emitting light within a spectral range from 435 nm to 485 nm, and one group of solid-state light emitters has green LEDs emitting light within spectral range from 515 nm to 540 nm, and one group of solid-state light emitters has yellow luminescent LED emitting light within a spectral range from 550 nm to 585 nm, and a group of solid-state light emitters has red LEDs emitting light within a spectral range from 610 nm to 640 nm.

10. The solid-state lighting module of claim 9, wherein the yellow luminescent LEDs includes a yellow luminescent material excited by blue or UV light.

11. The solid-state lighting module of claim 1, wherein the control circuit adjusts a light intensity by changing an amount of turn-on time or an amount of a driving current according to a pre-recorded data map for each color group in the programmable device.

12. The solid-state lighting module of claim 1, wherein the control circuit adjusts a color by changing an amount of turn-on time or an amount of a driving current according to a pre-recorded data map for each color group in the programmable device.

13. The solid-state lighting module of claim 1, wherein separated groups of solid-state light emitters include a blue color group, a yellow color group, a red color group, and a green color group.

14. The solid-state lighting module of claim 1, comprising an optical light mixer that mixes color of light from different separated color groups.

15. The solid-state lighting module of claim 14, wherein the single photodetector is configured to sense different wavelength spectrum of different solid-state light emitters in different separated color groups of solid-state light emitters, and wherein the optical light mixer is located between the separated groups of solid-state light emitters and the single photodetector.

16. The solid-state lighting module of claim 1, wherein the control circuit is configured to perform color profile correction by adjusting relative power ratios between different color groups.

17. A method for producing a color LED illumination module having color groups of LEDs that emit light of different colors between different groups and emit light of a designated color within a color group, comprising:

measuring a color spectrum of LEDs in the module that belong to a color group of LEDs that emit a particular color designated for the color group, generating a table of coefficients of color spectra of LEDs of the different color groups to enable identification of different intensities of each LED group from a desirable color map of combination lighting; and storing the table into a memory for the module to allow setting each LED light intensity according to the stored table in the memory.

18. The method of claim 17, comprising:

performing color profile correction by adjusting relative power ratios between different color groups.

* * * * *